United States Patent [19]

Buan et al.

[11] 4,412,491

[45] Nov. 1, 1983

[54] SYSTEM FOR SENSING AN INKING MEMBER IN A VALUE PRINTING DEVICE

[75] Inventors: Danilo P. Buan, Easton; Alton B. Eckert, Jr., Norwalk, both of Conn.

[73] Assignee: Pitney Bowes Inc., Stamford, Conn.

[21] Appl. No.: 334,955

[22] Filed: Dec. 28, 1981

[51] Int. Cl.[3] ..... B41F 3/40

[52] U.S. Cl. ..... 101/363; 101/364

[58] Field of Search ..... 101/363, 364, 366, 367; 200/47, 56 R, 61.41, 61.42

[56] References Cited

U.S. PATENT DOCUMENTS

| | | | |
|---|---|---|---|
| 3,589,288 | 6/1971 | Lake | 101/363 |
| 3,631,800 | 1/1972 | Mignone et al. | 101/366 |
| 4,202,267 | 5/1980 | Heinzl | 101/364 |
| 4,277,791 | 7/1981 | Rosenstock | 101/366 |

FOREIGN PATENT DOCUMENTS

| | | | |
|---|---|---|---|
| 723272 | 12/1965 | Canada | 200/61.41 |
| 2035213 | 6/1980 | United Kingdom | 101/366 |

*Primary Examiner*—E. H. Eickholt

*Attorney, Agent, or Firm*—Peter Vrahotes; Melvin J. Scolnick; Albert W. Scribner

[57] ABSTRACT

A value printing device, such as a postage meter, is provided with a switch for automatically signaling when a new inking member unit has been inserted into the device. The switch has a piercing member that closes the switch when a membrane or cover over an opening in the inking member is overcome by the piercing member.

7 Claims, 7 Drawing Figures

COUNTER
COUNT
RESET
4
6
7
8
9
10
10a
11
12
13
14
15
16
17
18
21
22
23
24
25

SYSTEM FOR SENSING AN INKING MEMBER IN A VALUE PRINTING DEVICE

BACKGROUND OF THE INVENTION

The invention disclosed herein relates to improved value printing devices such as electronic postage meters or registers, in which a novel system is provided for automatically signaling the device that a new ink roller has been inserted.

The invention also relates to such improved printing devices in which a novel system is provided for automatically and electronically warning the operator that an ink roller needs to be replaced by a fresh one.

Value printing devices such as labeling apparatus, postage meters and registers, and the like, print information onto a surface by contacting the surface with print characters which are inked typically just prior to the printing event. In a postage meter, for example, relative motion occurs between the print characters and an inking roller which contains its own supply of ink, which contacts and, thus inks the characters. While the various inventive aspects which follow will be described in connection with commercially available postage meters, it will be understood that they apply to any printing device with like characteristics.

In rotary-head postage meters and registers, such as Pitney Bowes' Models 5300, 6300 and 6500 meters, the print characters are contained in a rotary printing head which revolves relative to a stationary inking roller during the print cycle. When the raised print characters encounter the inking roller, they make contact and are thus inked. In the so called flat-bed postage meter, such as Pitney Bowes' Model 5700 series meter, the print characters are contained on a horizontal, flat printing head. The mailpiece to be marked is moved rapidly against the printing head with enough force to be marked. In the print cycle, the inking roller and its support carriage is moved across the print characters just before printing, the characters remaining stationary. After printing, the roller moves back across the printing head to its original rest position. The invention to be described can apply to both rotary and flat-bed postage meters and registers, but will be described specifically with regard to a flat-bed Model 5700 series meter, a meter available commercially for many years.

Various aspects of this type of postage meter have been described in the U.S. Pat. Nos. 3,069,084; 3,244,096; 3,310,139; and of a special interest to this disclosure U.S. Pat. No. 3,143,963. The latter patent relates to means for limiting the number of cycles of a postage meter in accordance with the capacity of the inking roller and thereafter rendering the ink roller unfit for use in the postage meter.

Currently, in the example of the Pitney Bowes' Model 5700 series postage meter, an ink roller is replaced when, in the operator's judgment, the impressions produced by the meter grow faint or weak. In some of the present day postage meters and registers, when a used cartridge is removed from the device, automatic security functions in the device disable it from use so that there is no risk of the operator mistakenly using postage values stored within the meter in the absence of a new cartridge having been inserted. However, when a new cartridge is inserted, the operator must remember to take appropriate steps with the device to cancel the disabled function so that the machine can then be used to print postage. Further, as before mentioned, there is currently no way for an operator to determine accurately when an inking cartridge has approached the end of its useful life. It is strictly within the operator's observation and discretion to determine when the postage impressions grow so faint or weak that a new cartridge must be inserted.

OBJECT OF THE INVENTION

It would therefore be desirable to have a value printing device which has incorporated within it a system for automatically signaling the device that a new inking member has been placed in it, which signal could be converted by the device's unit either to cancel any disabling functions activated by the absence of an inking member, and/or to activate another sub-unit which would control the number of printing cycles for which the fresh inking member is used. It is further desirable to have a value printing device having incorporated within it an automatic function to alert the operator that an inking member must be replaced with a fresh one.

It is accordingly the principal object of these inventions to provide such improved systems in value printing devices, such as electronic postage meters.

SUMMARY OF THE INVENTION

The first object is achieved by providing in such a printing device a system for automatically sensing the presence of a new inking member which comprises: an inking cartridge comprising a housing containing an inking member therein; a pierceable membrane contained thereon; sensing means comprising a piercing mechanism which activates an electric switch when the mechanism pierces the membrane; and means for causing the piercing mechanism to break said membrane.

A second object is achieved by providing a value printing device containing a system for automatically warning the operator that an inking member must be replaced by a fresh one, which comprises: electrical means for storing the number of cycles for which an inking member may be safely used and for generating an electric signal when the last cycle has been run; further electrical means for signaling the storing means that a fresh inking member has been inserted in the device so that the storing means commences a count of the printing cycles for the new inking member; and further electrical means capable of being noticed by an operator which is automatically activated by the storing means when the last cycle of the inking member has been run, thus alerting the operator that it is time to insert a fresh inking member.

DESCRIPTION OF THE INVENTION

Figure 1:
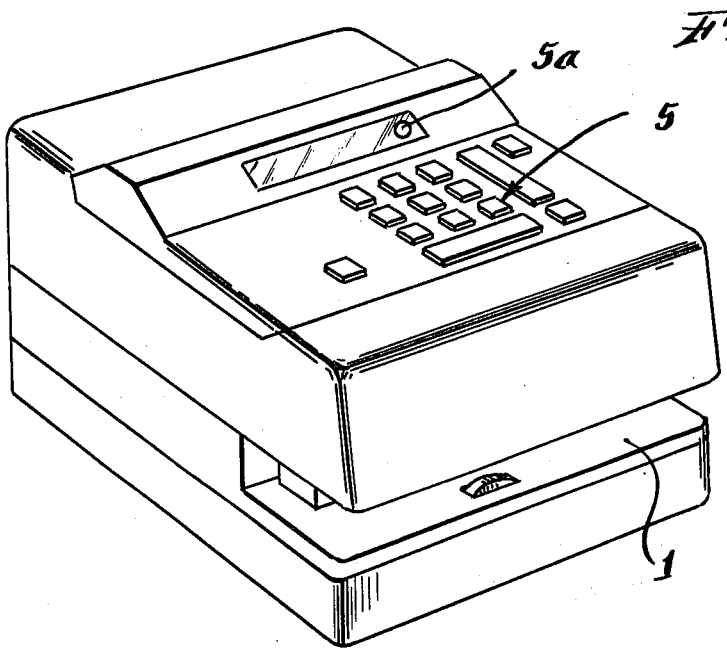
FIG. 1 is a front perspective view of a typical flat-bed electronic postage meter.
Figure 5:
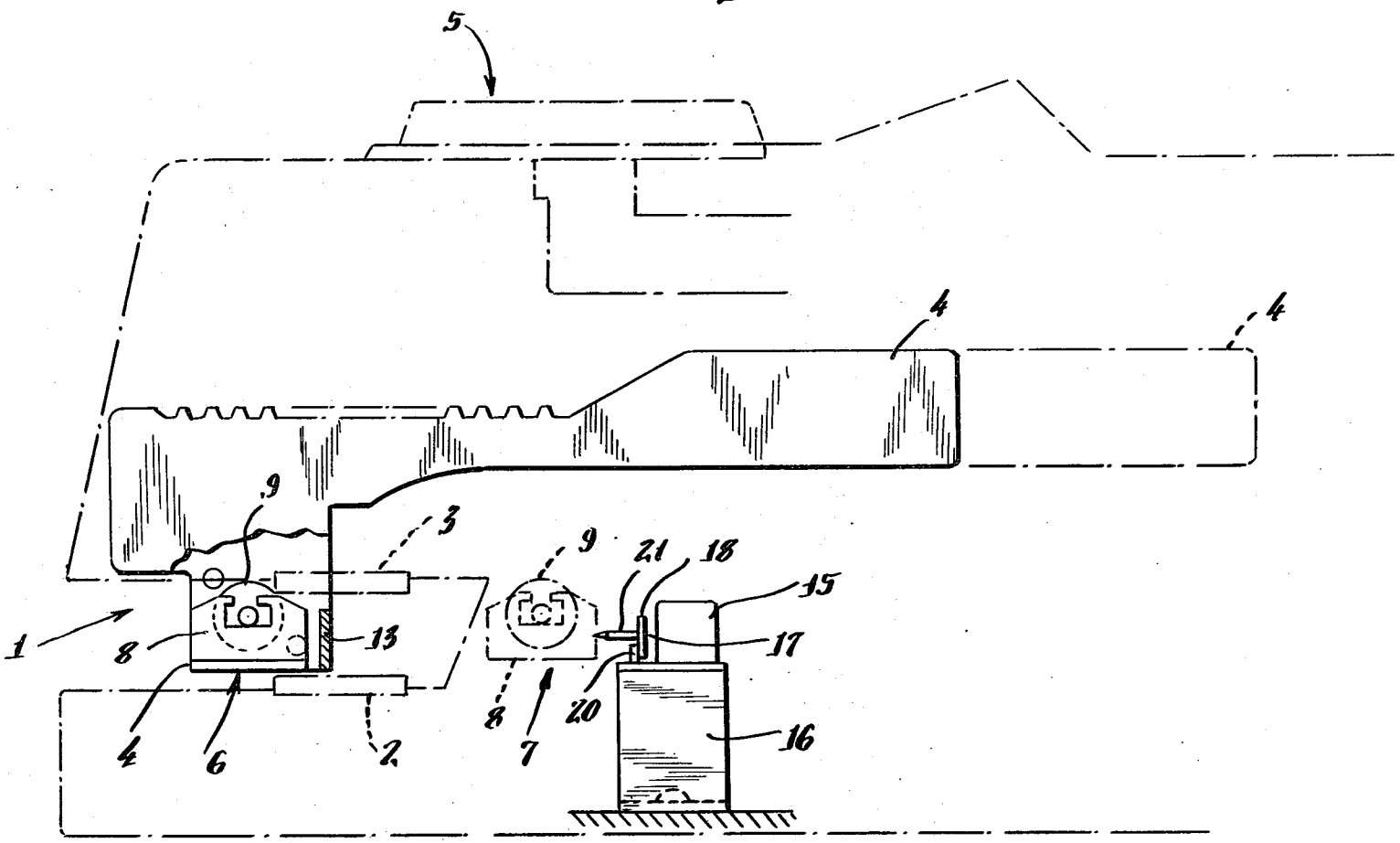
FIG. 5 is a side elevational view of a value printing device containing the inking roller sensing means of this invention.

Referring now to FIGS. 1 and 5 of the drawings, a typical commercially available flat-bed postage meter is illustrated, an example of which is a Pitney Bowes' Model 5700 series meter. A printing station is provided comprising a recess 1, into which a mailpiece is inserted for postage impression, as is well known to the art. Various aspects of this type of postage meter are described more fully in U.S. Pat. No. 3,143,096, and the other patents mentioned above. When a mailpiece is positioned in recess 1 properly so as to activate a switch (not shown), platen 2 is caused to move rapidly upward to force the mailpiece against a printing head or die 3 containing the raised print postage characters so as to be marked as desired. In the Model 5700 series, the movement of the device, the setting of postage values and the memory units are all controlled mechanically when the operator utilizes console keyboard 5.

The print characters contained on the printing die 3 are inked just prior to printing, as illustrated in FIG. 5. A rotatably mounted inking member such as an ink roller 9 is supported in the brackets of an inking carriage 4, which is mounted for left and right movement in the device, that is, from the front of the device toward the back of the device. As shown in FIG. 5, at the start of the printing cycle, the carriage 4 is in its rest or home position 6, and when the mailpiece is inserted and the printing cycle begun, the carriage 4 is automatically reciprocated to the right to position 7. As the carriage thus moves, roller 9 is wiped across the print characters on printing die 3 and the characters are thus inked. When the carriage is in its retracted position 7, platen 2 moves the mailpiece upward against the printing die 3 to place the postage values thereupon. After mailpiece removal, the carriage 4 is automatically moved back to its home position 6. The drive for automatically producing this movement is not shown here, but is adequately described in the patents above mentioned.

The ink rollers heretofore used in these devices are designed to be disposable when the ink supply which they contain has been exhausted to the point where the postage impressions become faint or illegible. The operator currently determines this by inspection of the quality of the postage impressions as time goes by. When the roller has reached the end of its useful life span, the operator then removes the spent roller by use of a special tool designed for that purpose. Should the roller fail to deliver legible postage impressions, or should the operator simply fail in his judgment of determining whether the postage impression quality is adequate, obviously postage values in the machine will be lost as the impressions are made, and the risk that a mailpiece will not be delivered is high.

In some value printing devices, when a used inking member is removed, automatic features of the device disable the device from producing any further impressions until a new inking member is inserted and the disabling functions are cancelled by the operator.

The present invention improves value printing devices by providing means which automatically alert the operator that a used inking member must be replaced and which automatically sense the presence of a new inking member so as to automatically cancel any disabling functions activated by the removal of the old inking member. Additionally, the latter means can be used to automatically trigger the former means which warns the operator that a new inking member must be inserted.

Figure 2:
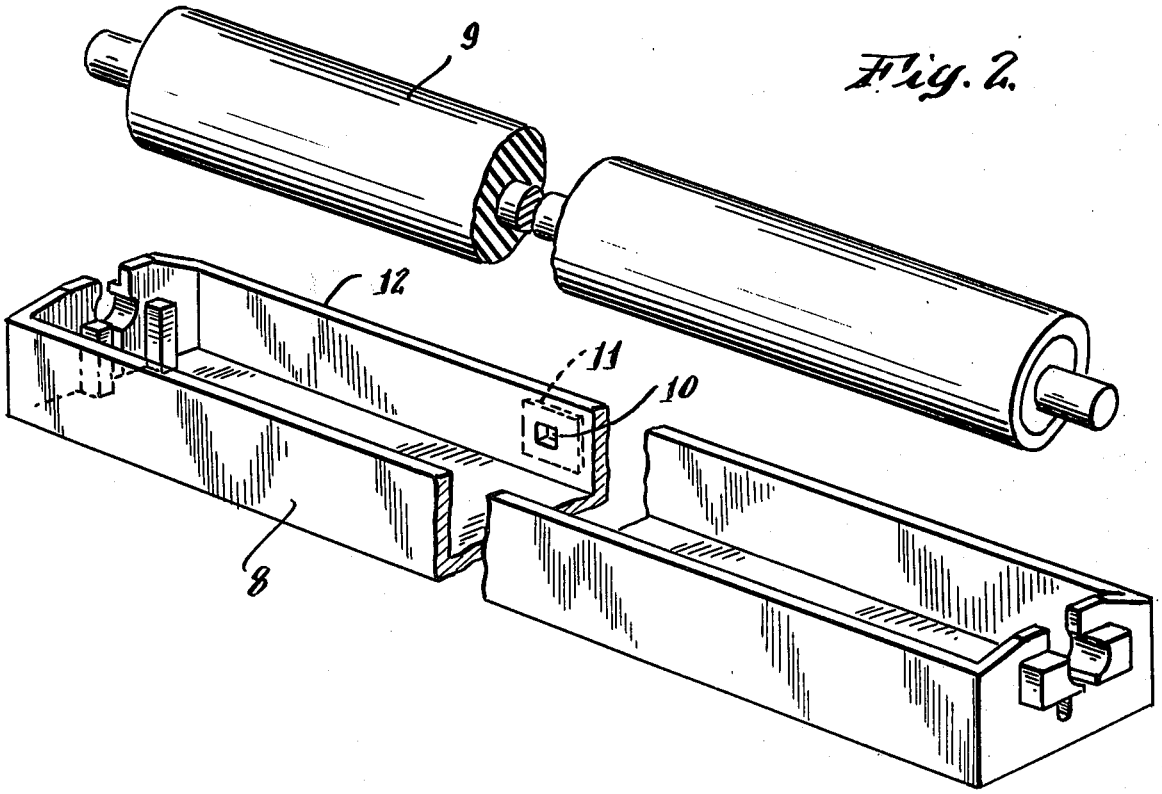
FIG. 2 is an exploded front perspective view of an inking cartridge having an ink roller which is useful in the inventive system.

Accordingly, a value printing device is provided with a system for automatically sensing the presence of a new inking member which will now be described by referring to the drawings, FIGS. 2–6. The inking member sensing system of this invention comprises an inking cartridge, one aspect of which is illustrated in FIG. 2. A housing 8 contains an inking roller 9 adapted to be rotatably mounted within the housing. Ink rollers 9 are typically comprised of porous resilient material containing a supply of ink, surrounding a central shaft which previously was mounted for rotation directly in the brackets of the movable carriage of the printing device. In this invention, the inking member is rotatably mounted within housing 8, which cartridge is then mounted for movement within the device by inserting the same into the movable carriage.

Still referring to FIG. 2, of central importance to this invention the cartridge housing 8 has an opening 10 in one wall thereof, said opening 10 being covered by a piercable tape or foil 11, on the exterior of the wall. In FIG. 2, the foil 11 is shown dashed in, indicating that, in this representation, it is located on the outside of the rear wall 12 of housing 8.

Figure 3:
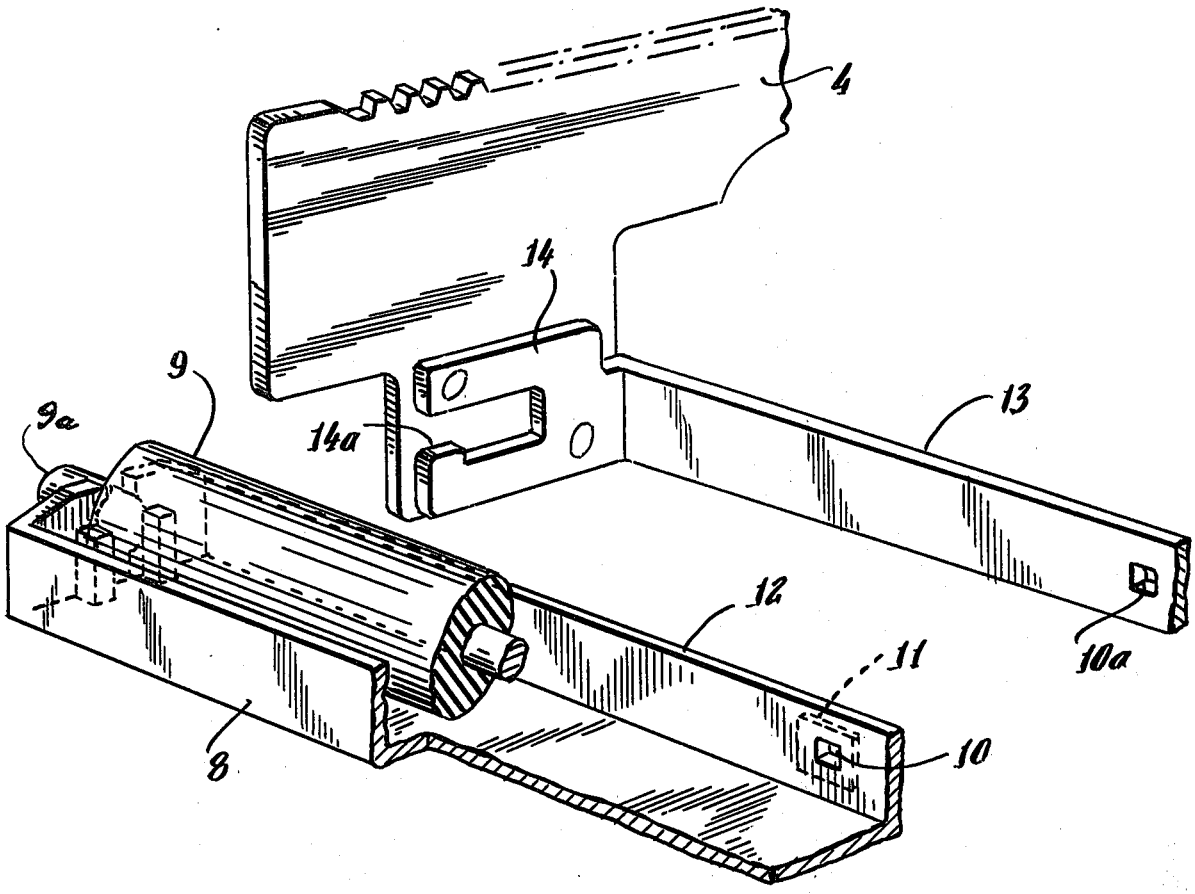
FIG. 3 is a perspective view in broken form of an inking cartridge and its carriage in a value printing device.

Referring to FIG. 3, the relationship between the inking cartridge and the printing device inking carriage is illustrated. The cartridge is shown in broken fashion with roller 9 mounted for rotation within housing 8, and again wherein an opening 10 exists in the rear wall 12 of housing 8 which is covered by a pierceable foil 11. Inking carriage 4 which moves into and out of the device during the printing cycle, is, in this case, fitted with a tie bar 13 having end brackets 14, one-half of the carriage being shown in FIG. 3. Brackets 14 are shaped to receive the end lugs 9*a* of the cartridge, and have a ridge 14*a* which, when the cartridge is inserted in the carriage, resists back and forth movement of the cartridge within the carriage brackets 14. Still referring to FIG. 3, the inking cartridge is moved into the carriage 4 by sliding the end lugs 9*a* thereof into the opening of brackets 14 and allowing the cartridge to sit within the bracket opening with the front edge of the lugs in abutting relationship with ridge 14*a*. As mentioned before, the details of the movement of inking carriage into and out of the value printing device are described in U.S. Pat. No. 3,143,963. Still referring to FIG. 3, carriage tie bar 13 has an opening 10*a*, which, when the inking cartridge is inserted into the carriage, is adapted to be in perfect alignment with the cartridge opening 10.

Figure 4:
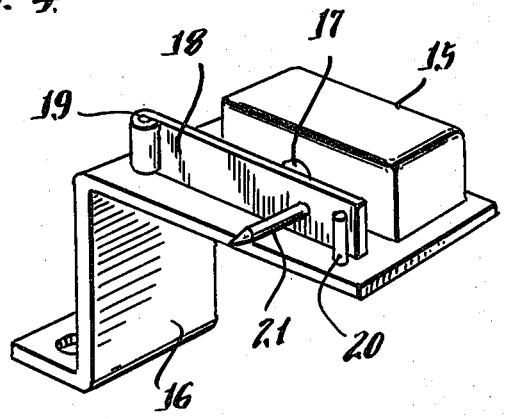
FIG. 4 is a perspective view of a preferred embodiment of a sensing means of this invention.

The inking member sensing system of this invention is further comprised of sensing means comprising a piercing mechanism connected to an electric signal generator, such as a switch. One aspect of the sensing means is illustrated in FIG. 4. A microswitch 15 is mounted on a support bracket 16 which is further fixedly mounted within the printing device. Microswitch 15 is activatable to produce an electric impulse by depression of push button 17 mounted within and extending outside of the microswitch. As with all such switches, a stop within the switch 15 resists depression of the button 17 up to a certain force level, beyond which the stop is breached and the switch sends a signal to another part of the device. In this particular case, since electronic postage meters are controlled by a microprocessing unit, microswitch 15 is electrically connected to said unit, which can then process the signal sent by the switch in any pre-programmed and desired manner.

Still referring to FIG. 4, a lever 18 is rotatably mounted on the support bracket 16 by means of hinge 19. Rotational movement of the lever 18 is restricted by post 20 fixedly mounted to the support 16. Lever 18 contains, on the side facing away from the switch 15, piercing means 21, in this case in the form of a pin. Backward movement of lever 18 is restricted by contact with button 17. Therefore the movement of lever 18 is substantially prevented by the counteropposing forces exerted by post 20 and push button 17.

Figures 6, 7:
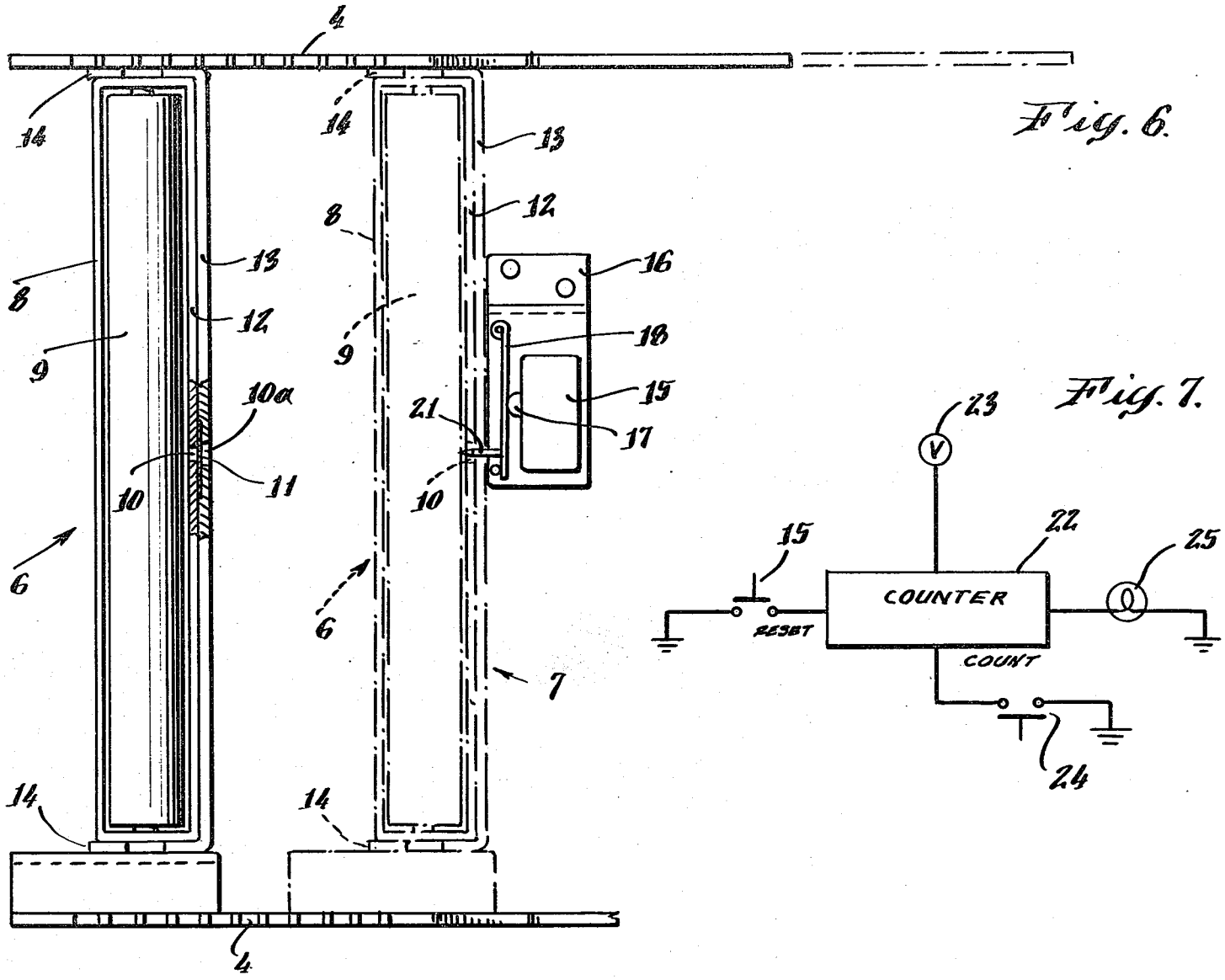
FIG. 6 is a top plan view of an inking system in a flat-bed type value printing device having the inking member sensing means of this invention.
FIG. 7 is a block diagram of an electrical system useful in the inventive system.

The operation of the above described elements in producing a sensing system should by now be clear. Referring to FIGS. 5 and 6, the support 16 containing the sensing means is mounted within the printing device in a fixed manner such that, when the inking carriage having the inking cartridge mounted thereon, moves in toward the printing device during the printing cycle, piercing means 21 will be in substantial alignment with openings 10 and 10*a* in the cartridge and carriage respectively. Additionally, the support 16 is mounted within the printing device such that piercing means 21 will encounter openings 10 and 10*a* and will forceably contact foil 11. The spatial relationship between the sensing means and the movement of the inking carriage should be such that piercing means 21 is capable of breaking foil 11 by moving through opening 10, but will not move in through opening 10 so far as to contact ink roller 9.

Still referring to FIGS. 5 and 6, with the elements mounted as described, when a new cartridge is inserted into the printing device containing an unbroken foil 11, on the first printing cycle, the carriage containing the cartridge will move in toward the device as usual to ink the print characters, and will encounter the sensing means. The carriage will move in towards the device far enough so that piercing mechanism 21 will go through opening 10*a* initially and continue to go through opening 10 as the carriage moves backward. When piercing means 21 encounters foil 11, it will break the foil, but not before the resistance to breakage forces lever 18 back towards switch 15, thus depressing button 17 and activating the switch. In this manner, the device is alerted by the microswitch 15 signal that a new inking member has been inserted into the device.

This movement is perhaps best illustrated in FIG. 6. As the printing cycle goes forward, carriage 4 is automatically reciprocated in towards the device from its rest position 6 to retracted position 7, and thereafter returns to position 6. When a new cartridge with an unbroken foil 11 is inserted in the device, the foil is designed to be broken by piercing means 21 as said means moves through openings 10/10*a* when the carriage approaches position 7. As before described, the force required to break the foil is designed to be in excess of the force required to move lever 18 back toward switch 15 and to depress the button 17 to activate the switch. Obviously, on all successive passes of the carriage into the device, although piercing means 21 will enter openings 10/10*a*, it will encounter no resistance since the tab or foil 11 has already been broken, and will generate no further signals from the switch 15.

The signal which is generated by activation of switch 15 may be utilized by the electro-mechanical units of the printing device in any manner desired. Thus, the signal may be used to automatically cancel printing device disabling features which were activated by the removal of an old inking member. Or, as will now be described with reference to another aspect of these inventions, the signal may also be used to activate an automatic system for alerting the operator that a new inking member must be placed in the device.

The inking member replacement warning system of this invention comprises electrical means capable of storing the useful life span of an inking member, such as by storing the number of cycles for which a given inking member may be safely used. In a preferred instance, in an electric postage meter, the first electrical means would be an electro-mechanical counter 22 of any suitable type which is advanced one digit at a time by the closure of the switch 24. This counter 22 would be preset to detect the number of cycles that a given inking roller can be used. This first electrical means also must be capable of generating an electrical impulse by comparing its count with the preset value indicating when the final cycle of a given inking member has been run, the impulse remaining until it is reset.

The replacement system also comprises second electrical means connected to the first for directing the first means to reset the inking member cycle count to zero, such as when a new inking member is inserted into the device. The system further comprises third electrical means connected with the first, which can be noticed by an operator, and which is automatically activated by the first means when the last cycle of an inking member has been run.

In a preferred aspect of said replacement system, the second electrical means is the system previously described for sensing the presence of a new inking member. Thus for example, when the piercing mechanism 21 encounters a new cartridge, and generates an electric signal by depressing the button of switch 15, that signal is sent to the counter, or first electrical means, which then utilizes the signal in a predetermined manner to commence a count of the printing cycles and compare said count with the number of cycles for which the new inking member can be safely run. The third electrical means is preferably an electric light 25 mounted on the keyboard console display 5*a*, which would be activated automatically by the counter unit 22 when the last inking cycle has been run. The operator would then know that a new inking member must be inserted in the printing device. The light 25 would remain lit for cycles in excess of the predetermined count and until a new inking member is inserted.

If the printing device having the replacement system is not equipped with the foregoing sensing system for sensing the presence of a new inking member, the second electrical means in the replacement system may be any suitable electrical device operable by the operator for signaling the first electric means or electromechanical counter 22 to reset to zero. Additionally, the third electrical means 25 for alerting the operator that the member must be replaced, could be an audible signal such as a buzzer or any other suitable means sensible to the operator sufficient to alert him to change the inking member.

In the preferred embodiment, the sensing system was described on a piercing mechanism 21 that ruptures a membrane or foil 11 on the first printing cycle. It will be appreciated that other combinations may be used equally as well to obtain a signal indicating the first printing cycle. For example, instead of a foil 11, one may use any breakable or permanently detachable member, such as hinged members or pop-out members, which upon the initial operation of the printing mechanism causes a signal to be sent indicative of such action. Instead of a piercing mechanism 21, one could use a contacting device such as a finger or lug that would contact the breakable or detachable member.

What is claimed is:

1. In a value printing device, a system for electronically sensing the presence of a new inking member, comprising:

(a) a cartridge having a housing containing an inking member, the housing having an opening with a detachable member therein;

(b) sensing means comprising:

i. contacting means mounted in said device substantially in alignment with said housing opening; and ii. electrical sensing means mounted stationary within the device and activatible by said contact means for generating signals; and (c) means for moving said cartridge with respect to said sensing means such that said contact means is caused to enter said housing opening upon movement of said cartridge; wherein when said contacting means contacts said detachable member is displace the same from said opening; said electrical sensing means is caused to generate at least one of said signals in response to the force exerted on said contacting means by said detachable means.

2. The system of claim 1 including a lever pivotally mounted within the device wherein said electrical sensing means is mounted adjacent said lever and comprises an electrical switch having a depressable means immediately adjacent said lever, whereby when said contacting means detaches said detachable member, said lever is caused to depress said depressable means to generate an electrical impulse from said switch.

3. In a value printing device, a system for electronically sensing the presence of a new inking member, comprising:

(a) a cartridge having a housing containing an inking member, the housing having an opening in a surface thereof, the opening being covered by a pierceable membrane;

(b) sensing means comprising:

i. piercing means mounted in said device substantially in alignment with said housing opening; and ii. electric sensing means activatible by said contact means for generating signals; and (c) means for causing relative movement between said cartridge and said sensing means such that said piercing means is caused to enter said housing opening during said relative movement; wherein when said piercing means enters said opening and pierces said membrane, said electrical sensing means is caused to generate at least one of said signals in response to the piercing force exerted on said piercing means.

4. The system of claim 3 in which said sensing means is mounted stationary within said device and wherein said cartridge is movable with respect thereto.

5. The system of claim 4 wherein said piercing means is comprised of a hinged lever having a piercing pin facing said cartridge housing opening.

6. The system of claim 5 wherein said electrical sensing means is mounted adjacent said lever and comprises an electrical switch having a depressable means immediately adjacent said lever.

7. The system of claim 6 wherein, when said piercing pin pierces said membrane, said lever is caused to depress said depressable membrane to generate an electrical impulse from said switch.

* * * * *